US012357063B2

(12) United States Patent
Mosier

(10) Patent No.: US 12,357,063 B2
(45) Date of Patent: Jul. 15, 2025

(54) REVERSIBLE PENDANT

(71) Applicant: Animare Designs LLC, Manhattan, KS (US)

(72) Inventor: Susan K. Mosier, Manhattan, KS (US)

(73) Assignee: ANIMARE DESIGNS LLC, Manhattan, KS (US)

( * ) Notice: Subject to any disclaimer, the term of this patent is extended or adjusted under 35 U.S.C. 154(b) by 0 days.

(21) Appl. No.: 18/449,454

(22) Filed: Aug. 14, 2023

(65) Prior Publication Data

US 2024/0057732 A1 Feb. 22, 2024

Related U.S. Application Data

(60) Provisional application No. 63/398,469, filed on Aug. 16, 2022.

(51) Int. Cl.
*A44C 25/00* (2006.01)

(52) U.S. Cl.
CPC ..... *A44C 25/001* (2013.01)

(58) Field of Classification Search
CPC . A44C 25/001; A44C 15/0025; A44C 25/005; A44C 25/007; A44C 5/102; A44C 5/10; A44C 7/00; A44C 13/00; A44C 25/00; A44C 5/0007; A44C 15/005
USPC ..... D11/93, 8, 79; 63/24, 21, 23, 38
See application file for complete search history.

(56) References Cited

U.S. PATENT DOCUMENTS

| | | | | | |
|---|---|---|---|---|---|
| D263,288 | S | * | 3/1982 | Errigo | D11/8 |
| D265,804 | S | * | 8/1982 | Barr | D11/8 |
| 6,006,547 | A | | 12/1999 | Bergagnini | |
| D516,934 | S | * | 3/2006 | Carnegie | D11/8 |
| D761,150 | S | | 7/2016 | Penna | |
| 9,408,442 | B1 | * | 8/2016 | Terry | A44C 15/004 |
| D833,326 | S | * | 11/2018 | Pierce | D11/121 |
| D869,980 | S | * | 12/2019 | Gruosi-Scheufele | D11/79 |
| 10,595,600 | B2 | * | 3/2020 | Stein | A44C 25/001 |
| D905,588 | S | * | 12/2020 | Yamada | D11/79 |
| 2014/0083136 | A1 | * | 3/2014 | Kruse | A44C 25/007 63/23 |
| 2015/0027166 | A1 | | 1/2015 | Mace | |
| 2019/0254393 | A1 | * | 8/2019 | Cabirou | A44C 7/00 |

* cited by examiner

*Primary Examiner* — Jack W Lavinder
(74) *Attorney, Agent, or Firm* — Husch Blackwell LLP

(57) ABSTRACT

A system is provided herein which may include a pendant holder and at least one reversible pendant configured to receive the pendant holder. The reversible pendant may include a slot defined at least partially therein. The slot may be configured to receive the pendant holder. The reversible pendant may be configured to rotate in the slot about the pendant holder. The reversible pendant may include a center of gravity, such that when the reversible pendant is in a first orientation, the pendant holder is positioned on a first side of the center of gravity of the reversible pendant and, when the at least one reversible pendant is in a second orientation, the pendant holder is positioned on a second side of the center of gravity of the reversible pendant.

19 Claims, 8 Drawing Sheets

REVERSIBLE PENDANT

CROSS-REFERENCE TO RELATED APPLICATIONS

The present application claims priority to U.S. Provisional Patent Application No. 63/398,469 entitled "Reversible Pendant," filed Aug. 16, 2022, the entire disclosure, including the specification and drawings, of which is incorporated herein by reference.

BACKGROUND OF THE INVENTION

Current systems provide necklaces, bracelets, and earrings (as well as other jewelry) that are static and cannot be changed. Because of this, individuals must purchase several different pieces of jewelry for different occasions. This can lead to increased spending and cluttered wardrobes. Present solutions fail to address needs for multi-purpose pieces, and as such, a need exists for jewelry that may be easily adapted and changed to fit any type of occasion.

BRIEF SUMMARY OF THE INVENTION

The present invention addresses current needs by providing a piece of jewelry or the like that may be changed to fit varying occasions and needs. The present disclosure is directed to a reversible pendant that may be optionally attached to or coupled with a pendant holder (which may be a chain for a necklace, bracelet, or earring). Any number of pendants may be placed on the pendant holder. The pendants may have varying designs, styles, embellishments, sizes, etc. and may be reversed for multi-purpose wear. The reversible pendant may include a slot which may be configured to rotate the pendant about the pendant holder. When rotated, different sides of the pendant may show.

More specifically, one embodiment of the present invention is directed to a system that includes a pendant holder and at least one reversible pendant. The slot defined in the reversible pendant may extend between first and second ends located on opposing sides of a center of gravity of the reversible pendant. When the reversible pendant is in a first orientation, the pendant holder is positioned at the first end of the slot on one side of the center of gravity of the reversible pendant. When in that first orientation, the reversible pendant is positioned such that a first side of the reversible pendant is exposed in a forward direction. Conversely, when the reversible pendant is in a second orientation, the pendant holder is positioned at the second end of the slot on an opposing side of the center of gravity of the reversible pendant. When in that second orientation, the reversible pendant is positioned such that a second side of the reversible pendant is exposed in a forward direction.

DETAILED DESCRIPTION OF THE INVENTION

Figure 1:
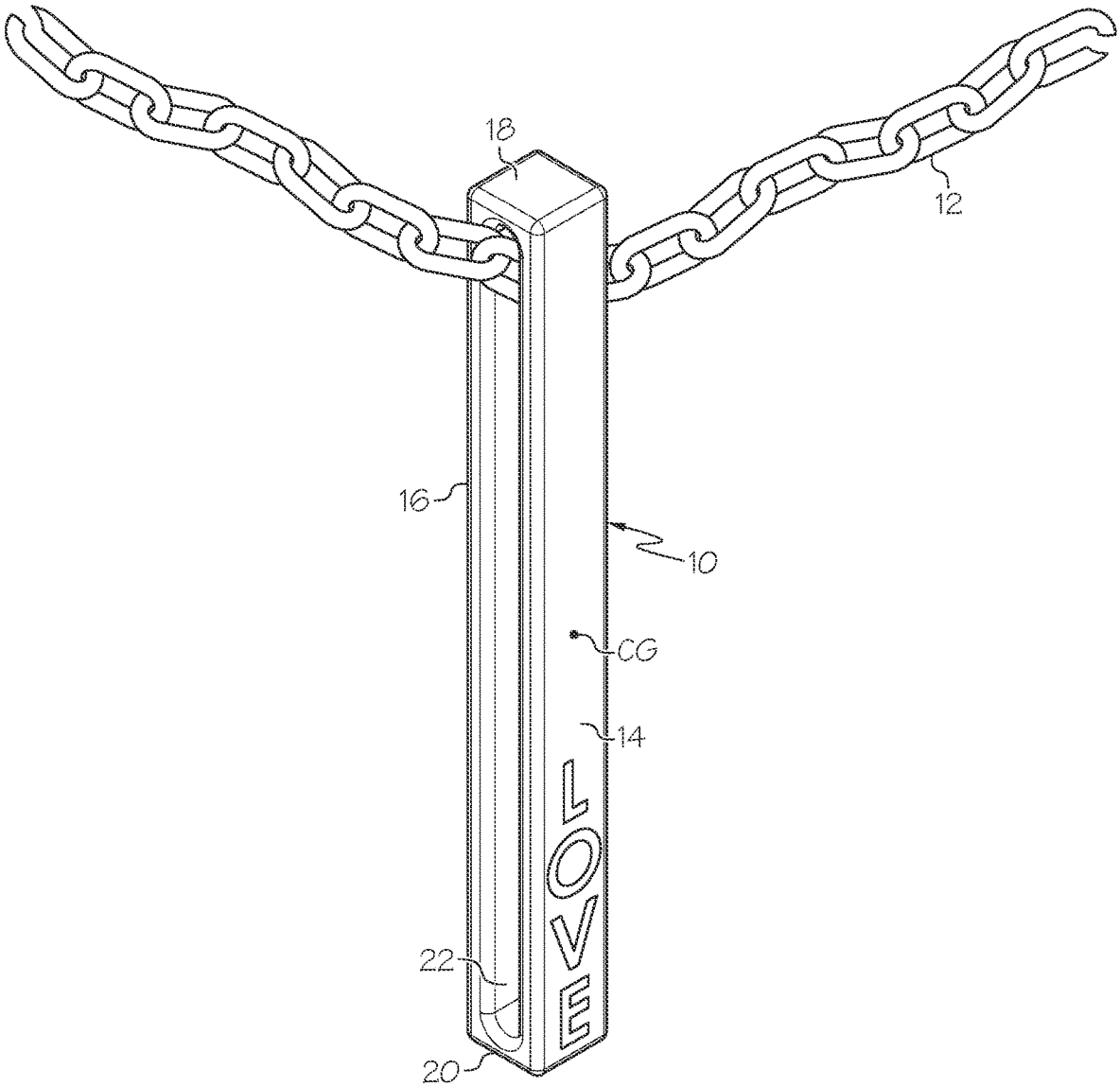
FIG. 1 is a first perspective view of a reversible pendant on a pendant holder in accordance with one embodiment of the present invention, illustrating the pendant in a first orientation and the holder in an upper portion of the slot.

The following discussion is presented to enable a person skilled in the art to make and use embodiments of the invention. Various modifications to the illustrated embodiments will be readily apparent to those skilled in the art, and the generic principles herein can be applied to other embodiments and applications without departing from embodiments of the invention. Accordingly, it is to be understood that the invention is not limited in its application to the details of construction and the arrangement of components set forth in the following description or illustrated in the attached drawings. Thus, embodiments of the invention are not intended to be limited to the embodiments shown but are to be accorded the widest scope consistent with the principles and features disclosed herein. The following detailed description is to be read with reference to the figures, in which like elements in different figures have like reference numerals. The figures, which are not necessarily to scale, depict selected embodiments and are not intended to limit the scope of embodiments of the invention. Skilled artisans will recognize the examples provided herein have many useful alternatives and fall within the scope of embodiments of the invention.

As used herein, unless otherwise specified or limited, the terms "mounted," "connected," "supported," and "coupled" and variations thereof are used broadly and encompass both direct and indirect mountings, connections, supports, and couplings. Further, unless otherwise specified or limited, "connected" and "coupled" are not restricted to physical or mechanical connections or couplings. Also, it is to be understood that the phraseology and terminology used herein is for the purpose of description and should not be regarded as limiting. For example, the use of "including," "comprising," or "having" and variations thereof herein is meant to encompass the items listed thereafter and equivalents thereof as well as additional items.

As used herein, unless otherwise specified or limited, "at least one of A, B, and C," and similar other phrases, are meant to indicate A, or B, or C, or any combination of A, B, and/or C. As such, this phrase, and similar other phrases can include single or multiple instances of A, B, and/or C, and, in the case that any of A, B, and/or C indicates a category of elements, can include single or multiple instances of any of the elements of the categories A, B, and/or C.

Turning first to FIG. 1, the present invention is directed generally to a reversible pendant 10 configured for being positioned in various orientations. In one embodiment, a system is provided wherein a reversible pendant 10 may be attached to a pendant holder 12 through a slot 22, which will be discussed in further detail below. The reversible pendant 10 may take any shape and may be made of various materials, including, but not limited to, metal (precious and non-precious), resins (including, but not limited to, all forms of 3D print resins), glass, plastic, wood, or any other suitable material now known or hereafter developed. The reversible pendant 10 may be of any color, texture, style, etc.

According to various embodiments, the pendant holder 12 may be, including, but not limited to, a chain for a necklace, bracelet, or earring. The pendant holder 12 may be made of various materials, including, but not limited to, metal (precious and non-precious), leather, silk thread, nylon thread, or any other suitable material now known or hereafter developed. As discussed in greater detail with reference to FIG. 8 below, in one embodiment, the pendant holder 12 may be optionally configured to receive multiple pendants. Any number of pendants may be attached to the pendant holder 12. The pendant holder 12 may hold other objects or items in addition to or in lieu of the reversible pendant 10 which may include beads of metal, glass, crystal, or any other suitable material or other suitable objects or items (for example, pearls, or leather knots) now known or hereafter developed.

According to one embodiment, the pendant holder 12 may optionally have one or more clasps for closure that prevent the reversible pendant 10 from falling off of the pendant holder 12, and/or may be opened for adding or removing one or more reversible pendants 10 from the pendant holder 12. In another embodiment, the pendant holder 12 may be optionally configured with one or more dual-functioning clasps that may be temporarily removable from the pendant holder 12. Due to their size relative to the size of the slot 22, such clasps may prevent a reversible pendant 10 from being added to or removed from the pendant holder 12 until the clasp is detached from the pendant holder 12.

According to various embodiments, the reversible pendant 10 may have a first side 14 and a second side 16. The first side 14 and second side 16 may have plain, smooth, or textured surfaces and may include, for example, words, numbers, shapes, artistic designs, or any other design or indicia. The first side 14 and second side 16 may include embedded, inlaid, or attached precious stones, semi-precious stones, crystals, enamel, cloisonne, glass, wood, metal, resin, or any other suitable material now known or hereafter developed. The first side 14 and second side 16 may be the same as or may be different than one another in terms of style and design. According to various embodiments, the reversible pendant 10 may have a first end 18 and a second end 20.

The reversible pendant 10 may have one or more slots 22 defined and extending partially or fully therethrough. In one embodiment, the reversible pendant 10 includes a single slot 22 that is defined and extends fully or entirely therethrough. The slot 22 may be configured to receive the pendant holder 12. According to various embodiments, the slot 22 may provide the capability for the reversible pendant 10 to be reversed while the pendant holder 12 is closed, preventing the reversible pendant 10 from coming off of the pendant holder 12. According to one embodiment, the pendant holder 12 may move within the slot 22. The slot 22 may be an elongate slot that extends to first and second opposing sides located on both sides of the center of gravity CG of the reversible pendant 10. The slot 22 may be any cross-sectional shape, including, but not limited to a straight or curved line, a Z-shape, a T-shape, or any other suitable shape.

As discussed in further detail below, when the reversible pendant 10 is in a first orientation (as demonstrated in FIG. 1), the pendant holder 12 is positioned on a first side of the center of gravity CG of the reversible pendant 10, and when the reversible pendant 10 is in a second orientation (as demonstrated in FIG. 3), the pendant holder 12 is positioned on a second side of the center of gravity CG of the reversible pendant 10. As also discussed in further detail below, when the reversible pendant 10 is in the first orientation (as demonstrated in FIG. 1), it is positioned such that the first face or side 14 is exposed in a forward direction, and when the reversible pendant 10 is in the second orientation (as demonstrated in FIG. 3), it is positioned such that the second face or side 16 is exposed in a forward direction.

As illustrated in FIG. 1, the first side 14 may face outward. When in this configuration, a design on the first side 14 may be showing. The first end 18 may be on the "top" of the reversible pendant 10, and the second end 20 may be on the "bottom" of the reversible pendant 10. The pendant holder 12 may be positioned at the top of the slot 22.

Figure 2:
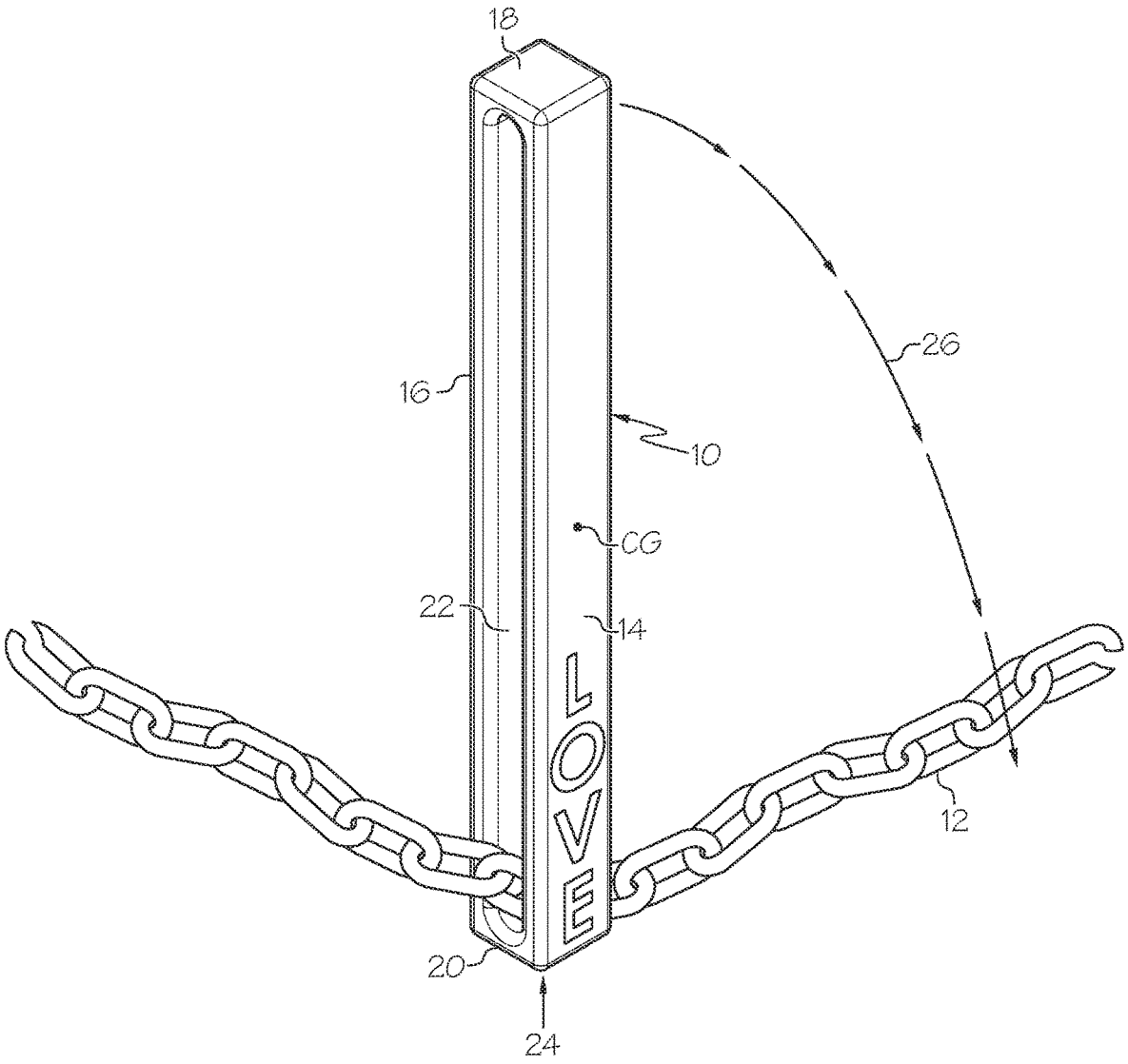
FIG. 2 is a perspective view of the reversible pendant on the pendant holder of FIG. 1, illustrating the holder in a lower portion of the slot.
Figure 3:
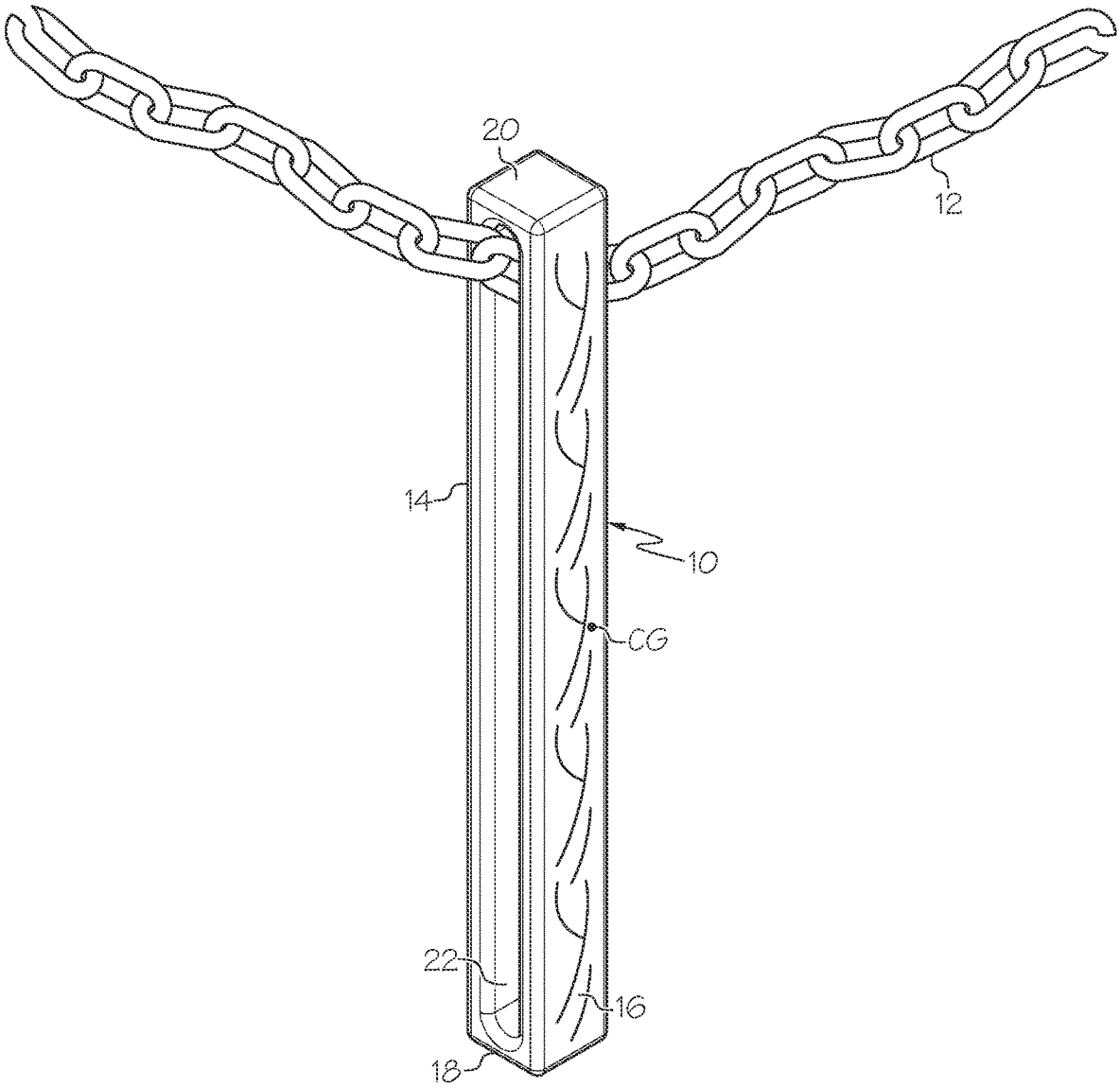
FIG. 3 is a second perspective view of the reversible pendant on the pendant holder in accordance with one embodiment of the present invention, illustrating the pendant in a second orientation and the holder in an upper portion of the slot.
Figure 4:
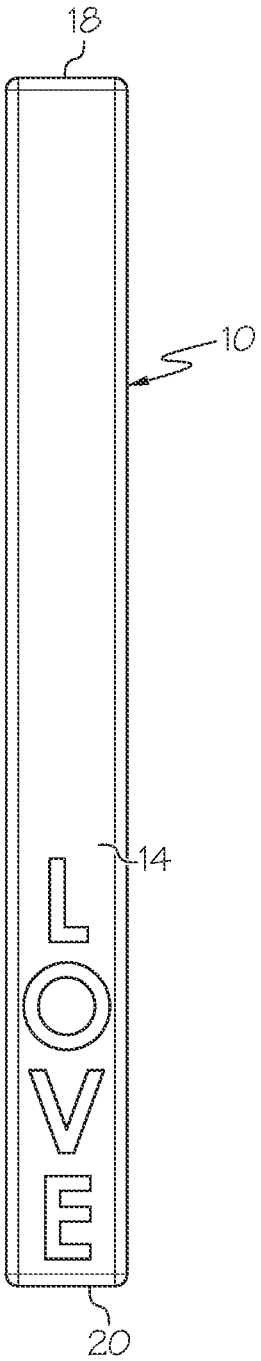
FIG. 4 is a front side view of the reversible pendant in accordance with one embodiment of the present invention.
Figure 5:
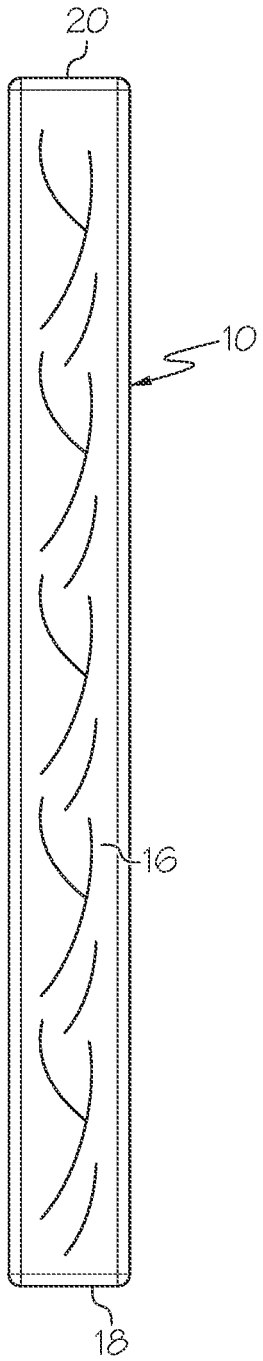
FIG. 5 is a back side view of the reversible pendant in accordance with one embodiment of the present invention.
Figure 6:
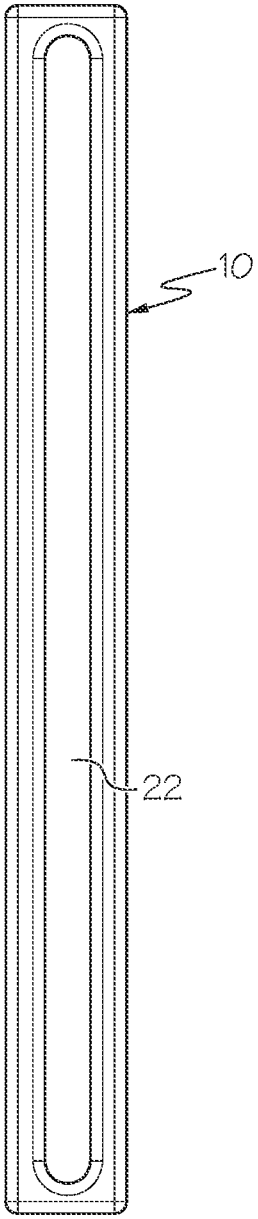
FIG. 6 is a right side view of the reversible pendant in accordance with one embodiment of the present invention.
Figure 7:
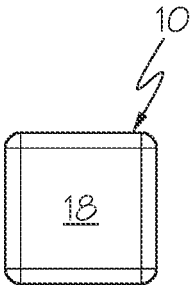
FIG. 7 is a top elevation view of the reversible pendant in accordance with one embodiment of the present invention.

As shown in FIG. 2, the first side 14 may face outward. When in this configuration, a design on the first side 14 may be showing. The first end 18 may be on the "top" of the reversible pendant 10, and the second end 20 may be on the "bottom" of the reversible pendant 10. The pendant holder 12 may be positioned at the bottom of the slot 22. As demonstrated by arrow 24, the reversible pendant 10 may be moved upward along the y-axis (as compared to the configuration shown in FIG. 1). As illustrated by the arrows 26 in FIG. 2, once the pendant holder 12 is positioned at or near the bottom of the slot 22, the reversible pendant 10 may be rotated forward or backward (e.g., rotated approximately 180 degrees) such that it becomes flipped and, thus, oriented as illustrated in FIG. 3. It will be appreciated that the reversible pendant 10 may alternatively be rotated first (either forward or backward) and then moved linearly relative to the pendant holder 12. To that end, simultaneous rotational and linearly movements of the reversible pendant 10 are possible as well.

Turning to FIG. 3, the second side 16 may face outward. When in this configuration, a design on the second side 16 may be showing. The first end 18 may be on the "bottom" of the reversible pendant 10, and the second end 20 may be on the "top" of the reversible pendant 10. The pendant holder 12 may be positioned at the top of the slot 22. Accordingly, the center of gravity CG of the reversible pendant 10 may be located below the pendant holder 12 so that the reversible pendant 10 hangs from the pendant holder 12. To achieve the configuration shown in FIG. 3 from the configuration shown in FIG. 1, the reversible pendant 10 may be flipped 180 degrees, as described above. In other words, to achieve the configuration shown in FIG. 3 from the configuration shown in FIG. 1, the reversible pendant 10 may be moved upward along the y-axis and flipped 180 degrees (as illustrated in FIG. 2) or vice versa.

FIGS. 4-7 illustrate varying views of the reversible pendant 10 according to embodiments of the present invention. The reversible pendant 10 and pendant holder 12 described herein may be constructed using any methods now known or hereafter developed, including 3D printing, casting, construction, molding, etc.

Figure 8:
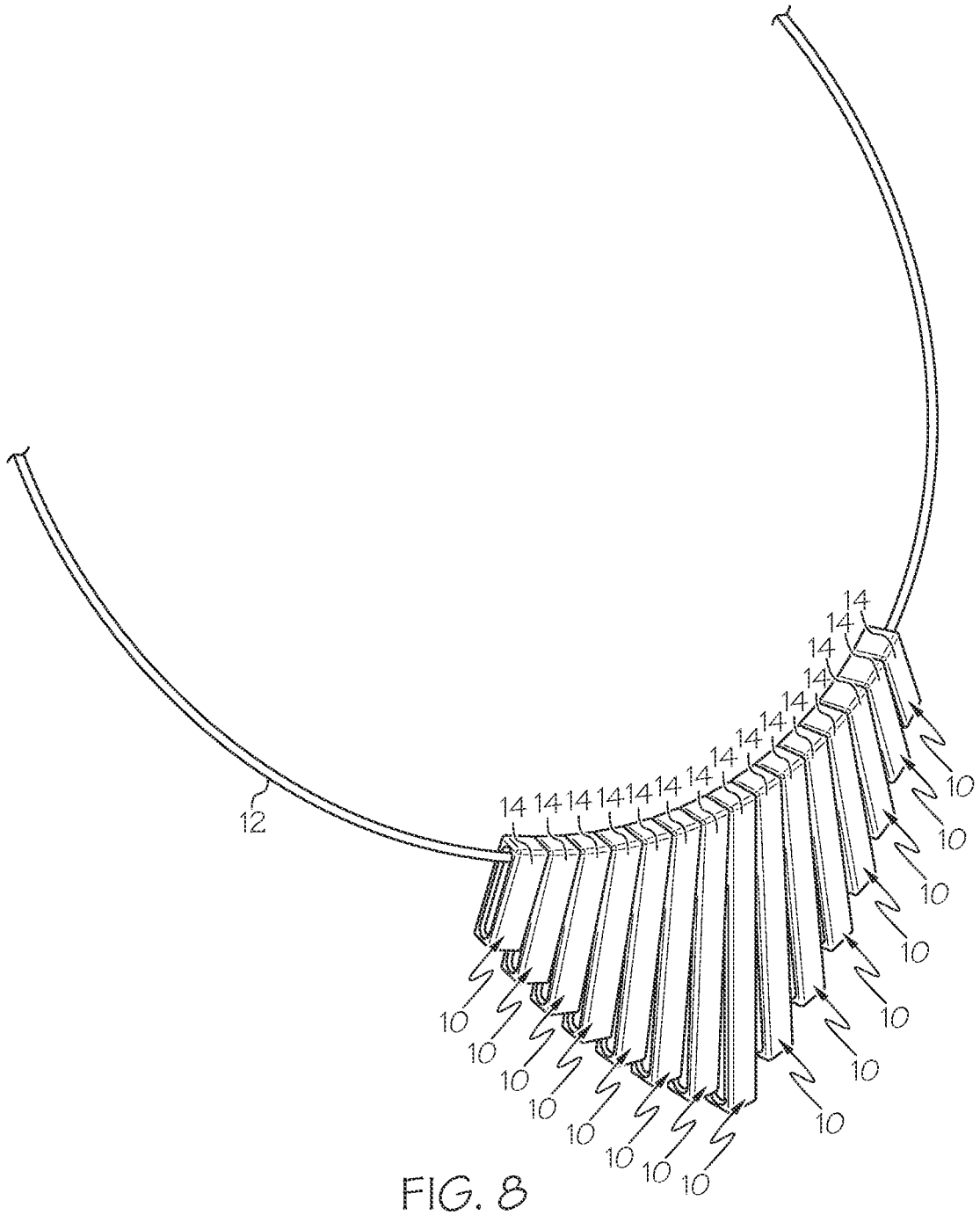
FIG. 8 is a further perspective view of multiple reversible pendants on a pendant holder in accordance with one embodiment of the present invention.

As illustrated in FIG. 8, the pendant holder 12 may be configured to hold multiple pendants 10. When the pendant holder 12 is configured with multiple pendants 10, each of the first sides 14 and/or the second sides 16 (not shown) may have words, numbers, shapes, photographs, paintings, puzzles, sentences, phrases, artistic designs, or any other design or indicia that may span across the multiple pendants 10 or may be on individual pendants 10. When the pendant holder 12 is configured with multiple pendants 10, the pendants 10 may be side-by-side (as illustrated in FIG. 8). In other embodiments, material (for example, beads of metal, resin, glass, crystal, pearls, leather knots, or any other suitable material or other suitable objects or items now known or hereafter developed) may be placed in between the pendants 10.

From the accompanying materials, it will be seen that the invention is one well adapted to attain all the ends and objects set forth herein with other advantages which are obvious and which are inherent to the structure. It will be understood that certain features and subcombinations are of utility and may be employed without reference to other features and subcombinations. This is contemplated by and is within the scope of the claims. Since many possible embodiments of the invention may be made without departing from the scope thereof, it is also to be understood that all matters herein set forth or shown in the accompanying drawings are to be interpreted as illustrative and not limiting.

The constructions described in the accompanying materials and illustrated in the drawings are presented by way of example only and are not intended to limit the concepts and principles of the present invention. Thus, there has been shown and described several embodiments of a novel invention. As is evident from the description, certain aspects of the present invention are not limited by the particular details of the examples illustrated herein, and it is therefore contemplated that other modifications and applications, or equivalents thereof, will occur to those skilled in the art. The terms "having" and "including" and similar terms as used in the foregoing specification are used in the sense of "optional" or "may include" and not as "required." Many changes, modifications, variations, and other uses and applications of the present construction will, however, become apparent to those skilled in the art after considering the specification and the accompanying drawings. All such changes, modifications, variations, and other uses and applications which do not depart from the spirit and scope of the invention are deemed to be covered by the invention which is limited only by the claims which follow.

What is claimed is:

1. A system comprising:

a pendant holder; and at least one reversible pendant including a length and a width, and wherein the length is greater than the width, and further including a slot defined at least partially within the at least one reversible pendant configured to receive the pendant holder, wherein the slot extends between first and second ends of the at least one reversible pendant located on opposing sides of the length and on opposing sides of a center of gravity of the at least one reversible pendant;

wherein the at least one reversible pendant is configured to rotate via the slot about the pendant holder;

wherein a first side of the at least one reversible pendant comprises a first surface and a second side of the at least one reversible pendant comprises a second surface, and wherein the first surface is different from the second surface;

wherein, when the at least one reversible pendant is in a first orientation, the pendant holder is positioned at the first end of the slot on one side of the length of the at least one reversible pendant;

wherein, when the at least one reversible pendant is in a second orientation, the pendant holder is positioned at the second end of the slot on an opposing side of the length of the at least one reversible pendant; and wherein the at least one reversible pendant is configured for being retained in two stable positions on either side of the center of gravity.

2. The system of claim 1, wherein:

when the at least one reversible pendant is in the first orientation, the at least one reversible pendant is positioned such that the first side of the at least one reversible pendant is exposed in a forward direction; and when the at least one reversible pendant is in the second orientation, the at least one reversible pendant is positioned such that the second side of the at least one reversible pendant is exposed in the forward direction.

3. The system of claim 1, wherein the slot is defined and extends fully through the at least one reversible pendant.

4. The system of claim 1, wherein the system includes two or more pendants positioned adjacent one another.

5. The system of claim 1, wherein the pendant holder is a chain for one of a necklace, bracelet, or earring.

6. The system of claim 1, wherein the at least one reversible pendant is made of at least one of precious metal, non-precious metal, resin, glass, plastic, or wood.

7. The system of claim 1, wherein:

the first surface comprises at least one of a first texture, word, phrase, number, shape, design, indicia, precious stone, semi-precious stone, crystal, enamel, cloisonne, glass, wood, metal, or resin;

the second surface comprises at least one of a second texture, word, phrase, number, shape, design, indicia, precious stone, semi-precious stone, crystal, enamel, cloisonne, glass, wood, metal, or resin that is different from that on the first surface;

the first texture is one of a plain, smooth, or textured surface; and the second texture is one of a plain, smooth, or textured surface.

8. The system of claim 1, wherein the first surface is different in appearance from the second surface.

9. The system of claim 1, wherein the first surface is different in at least one of style or design from the second surface.

10. A reversible pendant comprising:

a body;

a length and a width, and wherein the length is greater than the width; and a slot defined through the body configured for receiving a pendant holder therethrough, the slot extending between first and second ends of the reversible pendant located on opposing sides of the length and on opposing sides of a center of gravity of the reversible pendant;

wherein the reversible pendant is configured for being positioned in first and second orientations;

wherein when the reversible pendant is in the first orientation, the reversible pendant is configured such that the pendant holder is positioned at the first end of the slot on one side of the length of the reversible pendant;

wherein when the reversible pendant is in the second orientation, the reversible pendant is configured such that the pendant holder is positioned at the second end of the slot on an opposing side of the length of the reversible pendant;

wherein a first side of the reversible pendant comprises a first surface and a second side of the reversible pendant comprises a second surface, and wherein the first surface is different from the second surface; and wherein the reversible pendant is configured for being retained in two stable positions on either side of the center of gravity.

11. The reversible pendant of claim 10, wherein the reversible pendant is configured to rotate via the slot about the pendant holder.

12. The reversible pendant of claim 10, wherein the reversible pendant is made of at least one of precious metal, non-precious metal, resin, glass, plastic, and wood.

13. The reversible pendant of claim 10, wherein:

when the reversible pendant is in the first orientation, the reversible pendant is positioned such that the first side of the reversible pendant is exposed in a forward direction; and when the reversible pendant is in the second orientation, the reversible pendant is positioned such that the second side of the reversible pendant is exposed in the forward direction.

14. The reversible pendant of claim 10, wherein the first surface is different in appearance from the second surface.

15. The reversible pendant of claim 10, wherein the first surface is different in at least one of style or design from the second surface.

16. A system comprising:

a pendant holder; and a plurality of reversible pendants, wherein each of the reversible pendants comprises a length and a width, and wherein the length is greater than the width, and further comprises a slot configured to receive the pendant holder;

wherein the slot of each reversible pendant extends between first and second ends of such reversible pendant located on opposing sides of the length and on opposing sides of a center of gravity of such reversible pendant;

wherein each of the reversible pendants is configured to rotate about the pendant holder;

wherein a first side of each of the reversible pendants comprises a first surface and a second side of each of the reversible pendants comprises a second surface, and wherein the first surface is different from the second surface;

wherein the pendant holder is a chain for one of a necklace, bracelet, or earring;

wherein, when each of the reversible pendants is in a first orientation, the pendant holder is positioned at the first end of the slot on one side of the length of each of the reversible pendants;

wherein, when each of the reversible pendants is in a second orientation, the pendant holder is positioned at the second end of the slot on an opposing side of the length of each of the reversible pendants; and wherein each of the reversible pendants is configured for being retained in two stable positions on either side of the center of gravity.

17. The system of claim 16, wherein:

when the reversible pendants are each in the first orientation, each reversible pendant is positioned such that the first side of such reversible pendant is exposed in a forward direction; and when the reversible pendants are each in the second orientation, each reversible pendant is positioned such that the second side of such reversible pendant is exposed in the forward direction.

18. The system of claim 16, wherein the first surface is different in appearance from the second surface.

19. The system of claim 16, wherein the first surface is different in at least one of style or design from the second surface.

* * * * *